United States Patent [19]

Schneider et al.

[11] Patent Number: 4,813,342

[45] Date of Patent: Mar. 21, 1989

[54] CRYOGENIC PUMP MULTI-PART PISTON WITH THERMAL EXPANSIVITY COMPENSATED POLYTETRAFLUOROETHYLENE SEAL RINGS

[75] Inventors: Gottfried Schneider, Stuttgart; Walter Peschka, Sindelfingen, both of Fed. Rep. of Germany

[73] Assignee: Deutsche Forschungs- und Versuchsanstalt fur Luft- und Raumfahrt e.V., Fed. Rep. of Germany

[21] Appl. No.: 63,251

[22] Filed: Jun. 17, 1987

[30] Foreign Application Priority Data

Jun. 28, 1986 [DE] Fed. Rep. of Germany ..... 3621726

[51] Int. Cl.[4] ..... F16J 9/10; F16J 9/28; F04B 15/08

[52] U.S. Cl. ..... 92/207; 92/253; 92/259; 417/901; 277/26; 277/117

[58] Field of Search ..... 92/201, 203, 204, 205, 92/206, 207, 242, 245, 246, 253, 257, 258, 259; 60/520; 417/901; 62/6; 277/26

[56] References Cited

U.S. PATENT DOCUMENTS

| | | | |
|---|---|---|---|
| 1,054,345 | 2/1913 | Frank | 92/207 |
| 1,520,173 | 12/1924 | Carr et al. | 92/205 |
| 1,657,478 | 1/1928 | Kraus | 92/207 |
| 2,632,678 | 3/1953 | Gault | 92/258 X |
| 3,015,529 | 1/1962 | Hardcastle | 92/259 X |
| 3,352,213 | 11/1967 | Karol | 92/204 X |
| 3,612,545 | 10/1971 | Storms | 277/26 |
| 3,999,768 | 12/1976 | Jepsen | 92/255 X |
| 4,156,584 | 5/1979 | Schuck | 417/435 |
| 4,226,169 | 10/1980 | Mazur et al. | 92/205 X |
| 4,396,362 | 8/1983 | Thompson et al. | 417/439 |
| 4,447,195 | 5/1984 | Schuck | 417/901 X |
| 4,578,956 | 4/1986 | Young | 62/6 |

FOREIGN PATENT DOCUMENTS 2061802 9/1971 Fed. Rep. of Germany .

OTHER PUBLICATIONS

Burr, M. E., "The Development of Large Diameter, High Pressure, Cryogenic Radial Static Seals, " ASLE Preprint 76-AM-5B-2, paper presented at the 31st Annual ASLE Meeting; Philadelphia, Penn., May 10-13, 1976.

Patent Abstracts of Japan, Section M, vol. 6 (1982), No. 130, (M-143)—JP 57-56 678 (4-5-82).

Gottzmann, C. F., "High Pressure Liquid Hydrogen and Helium Pumps," AICE, *Advances in Cryogenic Engineering*, vol. 5, 1960, pp. 289-298.

*Primary Examiner*—Robert E. Garrett
*Assistant Examiner*—George Kapsalas
*Attorney, Agent, or Firm*—Wolf, Greenfield & Sacks

[57] ABSTRACT

A reciprocating pump for a cryogenic fluid includes a pump cylinder made of a material with low thermal expansivity, a piston displaceable in the pump cylinder, and self-lubricating piston rings made of polytetrafluorethylene held on the circumferential surface of the piston. The rings have a larger thermal expansivity than the pump cylinder. The arrangement allows optimum matching of piston rings and pump cylinder at cryogenic fluid pumping temperatures. The piston has a core made of a material with relatively large thermal expansivity which is surrounded by a spacer sleeve made of a material with a low coefficient of thermal expansion. The core protrudes on both sides from the spacer sleeve and has expanding regions increasing conically towards its free ends. The piston rings surround the core in the expanding regions and are supported against the end faces of spacer sleeve. The conical expanding regions bias the rings toward the cylinder at low temperatures to insure effective sealing.

7 Claims, 2 Drawing Sheets

Fig.3
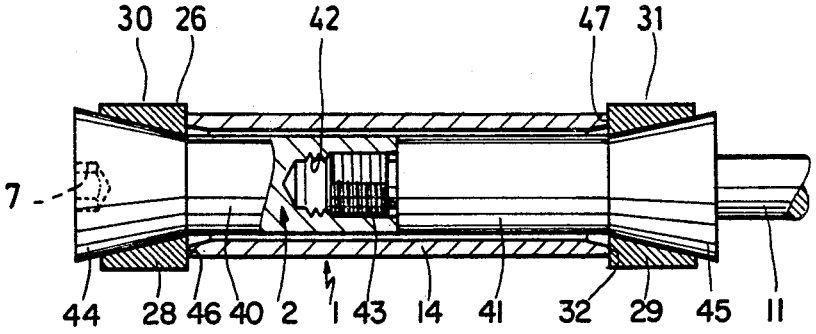
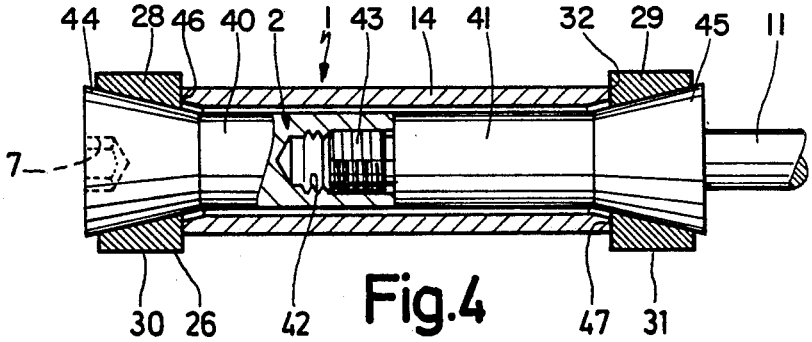
Fig.4

CRYOGENIC PUMP MULTI-PART PISTON WITH THERMAL EXPANSIVITY COMPENSATED POLYTETRAFLUOROETHYLENE SEAL RINGS

BACKGROUND OF THE INVENTION

1. Field of the Invention

The invention relates to a reciprocating pump for a cryogenic fluid comprising a pump cylinder made of a material with low thermal expansion, a piston displaceable in the pump cylinder, and piston rings made of a self-lubricating material with a larger coefficient of thermal expansion than the material of the pump cylinder held on the circumferential surface of the piston.

2. Description of the Prior Art

In reciprocating pumps for cryogenic fluids, for example, liquid nitrogen and liquid hydrogen, a number of problems arise due to the boiling state of the cryogenic fluids, their low temperatures and their low kinematic viscosity: The low temperatures limit the choice of materials to a considerable degree. Shrinkage problems occur, in particular, in the pairing of piston and cylinder. Use of additive lubricants is not possible. Owing to the low kinematic viscosity of the fluids to be pumped one is dependent on self-lubricating surfaces of piston and cylinder. Usually, sealing is effected by piston rings on the pistons with self-lubricating properties, for example, piston rings made of PTFE, PTFE-carbon, PTFE-graphite or PTFE-bronze. Pumps of this kind are known, for example, from U.S. Pat. Nos. 4,156,584 and 4,396,362 and also from the article by C. F. Gottzmann, "High-Pressure Liquid-Hydrogen and -Helium Pumps", AICE, *Advances in Cryogenic Engineering*, Volume 5, 1960, pp. 289–98.

With self-lubricating piston rings made of PTFE-graphite, PTFE-carbon or similar substances, good self-lubricating properties are obtained with respect to steel. However, the high thermal expansion coefficient of these piston rings in relation to the pump cylinder material, on the one hand, and to the piston material, on the other hand, is disadvantageous. When cooled from ambient temperature to 77 K., the thermal expansivity of PTFE is six to seven times higher than in high-grade steel and almost forty times higher than in Fe Ni 36 steel. The radial shrinking of the PTFE piston rings is, therefore, critical.

With slotted piston rings, the shrinkage can be compensated by spring pretensioning by means of beryllium copper springs, but the leak through the slot and the high manufacturing expenditure are disadvantageous.

With unslotted PTFE piston rings, the gap between piston and cylinder which increases in size during cooling-down can be reduced by a combination of several measures:

1. The piston ring thickness is reduced as far as technically possible in order to reduce the absolute shrinkage;

2. By shrink-fitting the ring on an Fe Ni 36 piston, the internal diameter of the piston ring remains practically constant during cooling-down so that the lateral contraction is the only decisive factor;

3. By using austenitic steels which are tough at low temperatures as cylinder material, the gap is finally reduced to the difference between the lateral contraction of the PTFE and the shrinkage of the cylinder made of tough austenitic low-temperature steel. The sealing achieved in this way is still insufficient for high-pressure pumps (pressure increase >10 bar).

Departing from a reciprocating pump of the generic kind, the object underlying the invention is to achieve substantially temperature-independent sealing between piston rings and pump cylinder although the thermal expansion coefficients of the piston ring material and the cylinder material are different.

This object is attained in accordance with the invention in a reciprocating pump of the kind described at the outset by the piston having a core made of a material with relatively large thermal expansivity surrounded by a sleeve made of a material with low thermal expansion, by the core protruding on both sides from the sleeve and having expanding regions conically increasing towards its free ends and by the piston rings surrounding the core in the expanding regions and being supported against the end faces of the sleeve.

Owing to this design, the axial contraction of the core of the piston during cooling-down is greater than that of the surrounding sleeve. Hence during cooling-down the piston rings on the conically expanding regions of the core are axially displaced into regions of larger diameter. This results in expansion of the piston rings. In this case, the dimensions may be selected such that this expansion of the piston rings by the expanding regions of the core compensates the shrinkage of the piston rings to such an extent that the resulting shrinkage of the piston rings corresponds to the shrinkage of the pump cylinder dimensions.

In a preferred embodiment, the piston rings directly abut the conically expanding regions of the core, and, therefore, undergo axial displacement on the core during cooling-down.

The core may consist of two components joined together within the sleeve. This facilitates assembly of the piston.

In another preferred embodiment, the expanding regions of the core are surrounded by a bearing ring divided up into segments by radial cuts to enable radial expansion of the bearing ring when axially displaced on the conically expanding region. The bearing ring is supported against the end face of the sleeve and the piston ring surrounds the bearing ring and is held on it. In this embodiment, it is the bearing ring that first undergoes expansion during cooling-down and it then transfers its expansion to the piston ring surrounding it.

In this case, it is expedient for a conical surface of the bearing ring to abut the conical surface of the expanding region of the core, with the conicity of both parts being substantially identical.

The expanding region of the core may be positioned on and releasable from the core at least at one of its ends. This also facilitates piston assembly.

The expanding regions preferably comprise axially protruding flanges acting as axial stop for the piston ring.

The following description of preferred embodiments serves in conjunction with the appended drawings to explain the invention in greater detail. In the drawings:

DESCRIPTION OF THE DRAWINGS

FIG. 3 is a view similar to FIG. 1 of a further preferred embodiment of a piston at ambient temperature; and FIG. 4 is a view similar to FIG. 3 of a piston at low temperatures.

DETAILED DESCRIPTION OF THE PREFERRED EMBODIMENTS

The drawings show only the piston of a reciprocating pump for a cryogenic fluid, for example, liquid nitrogen or liquid hydrogen. The pump cylinder surrounding the piston, the inlet and outlet valves and the piston drive may be of conventional design.

Figure 1:
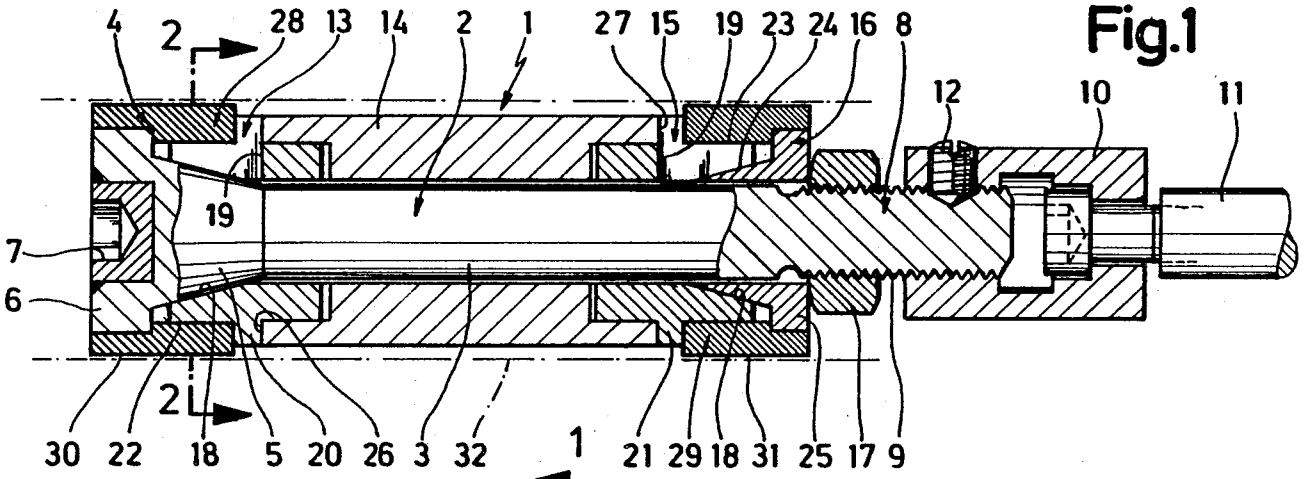
FIG. 1 is a longitudinal sectional view though a piston in a first preferred embodiment of the invention.
Figure 2:
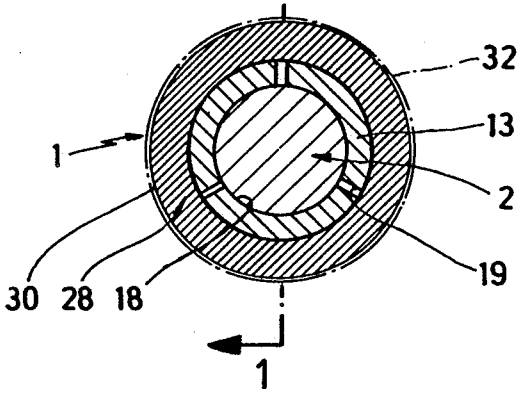
FIG. 2 is a sectional view taken along line 2—2 in FIG. 1.

The piston 1 of the embodiment shown in FIGS. 1 and 2 comprises an elongate, axially symmetrical core consisting essentially of a cylindrical shaft 3 and an expanding region 5 increasing conically at one end 4. The expanding region 5 is delimited by a radially protruding flange 6. An opening 7 for insertion of a hexagonal wrench is machined in the end face of core 2.

At the opposite end 8, the shaft has an external thread 9 and is screwed into a coupling member 10 which is connected to an oscillatingly driven push-pull rod 11. Shaft 3 is fixed in coupling member 10 by a set screw 12 screwed radially into the coupling member.

Successively positioned on core 2, from the free end 8, are a first bearing ring 13, a spacer sleeve 14, a second bearing ring 15 and an expanding member 16. These components are fixed on the core by a nut 17 screwed onto the external thread 9.

The two bearing rings 13,15 have conically expanding inner surfaces 18. Their conicity corresponds substantially to the conicity of expanding region 5 and expanding member 16, respectively. The inner surfaces 18 abut expanding region 5 and expanding member 16, respectively. Both bearing rings comprise radial cuts 19, each offset by 120 degrees in the circumferential direction (FIG. 2) to enable radial expansion and compression of bearing rings 13 and 15 in the way in which collet chucks operate. The circumferential surfaces 22 and 23 of bearing rings 13 and 15, respectively, are of circular-cylindrical configuration. They terminate in a radially outwardly protruding annular shoulder 20 and 21, respectively, on the side on which the two bearing rings face each other. The circumference of circumferential surface 22 is smaller than the circumference of flange 6 of core 2.

Expanding member 16 takes the form of a ring with a conically expanding abutment surface 24 terminating in a radially outwardly protruding flange 25. The circumference of flange 25 is larger than the circumference of circumferential surface 23 of bearing ring 15.

Both bearing rings 13 and 15 extend into spacer sleeve 14. The annular shoulders 20 and 21 of the two bearing rings are supported against the end faces 26 and 27, respectively, of spacer sleeve 14.

Mounted on the two circumferential surfaces 22 and 23 of the two bearing rings 13 and 15, respectively, is a piston ring 28 and 29, respectively. These also embrace flange 6 and flange 25, respectively. In the region of these flanges, both piston rings have a recess on their inner side. The piston rings are thereby axially fixed in the region between flanges 6 and 25, respectively, on the one hand, and annular shoulders 20 and 21, respectively, on the other hand.

The outer surfaces 30 and 31 of the two piston rings 28 and 29 are of circular-cylindrical configuration and sealingly abut the inside wall of a pump cylinder 32 illustrated by a dot-and-dash line in the drawings.

The materials are selected such that the spacer sleeve exhibits the smallest thermal expansivity, the piston rings the largest thermal expansion and the core a thermal expansivity between that of the spacer sleeve and that of the piston rings. The piston rings consist, for example, of PTFE, PTFE-carbon, PTFE-graphite, PTFE-bronze or brass. The spacer sleeve is made of Fe Ni 36 steel (In 36) and the core consists of austenitic steel which is tough at low temperatures, aluminum, titanium or bronze.

On account of this coordination of the thermal expansion coefficients of the individual materials and of the different structural design, axial contraction of the core 2 during cooling-down is greater than that of spacer sleeve 14. Consequently, expanding region 5 and expanding member 16 of core 2 are drawn into bearing rings 13 and 15 during cooling-down and thereby expand these. This simultaneously causes expansion of piston rings 28 and 29 resting on the bearing rings. Suitable coordination of the thermal expansion coefficients of the core, the spacer sleeve and the piston rings, on the one hand, and of the dimensions of the individual components, in particular, the conicity of the two expanding regions, on the other hand, results in the outer surfaces 30 and 31 of the piston rings 28 and 29 having an unaltered diameter or even better an outer diameter adpated to the thermal expansion behavior of the pump cylinder 32 over a large temperature range. In this way, perfect sealing between piston 1 and pump cylinder 32 over a large temperature range is achieved.

The piston illustrated in FIGS. 1 and 2 is easy to assemble. To do so, bearing ring 13 with piston ring 28 arranged thereon, spacer sleeve 14, bearing ring 15 with piston ring 29 arranged thereon and expanding member 16 are successively positioned on core 2 and subsequently fixed by nut 17 on core 2. The thus assembled piston can then be screwed into coupling member 10 and fixed therein.

In the embodiment shown in FIGS. 3 and 4, like parts are designated by the same reference numerals. The pump cylinder of this embodiment is not illustrated in the drawings.

In this embodiment, core 2 consists of two components 40,41 comprising within the surrounding spacer sleeve 14 a threaded bore 42 and a threaded pin 43 which can be screwed together.

Both components 40 and 41 comprise at their ends 4 protruding from spacer sleeve 14 a conically expanding region 44 and 45, respectively. Expanding region 44 corresponds to expanding region 5 in the embodiment shown in FIGS. 1 and 2.

In this embodiment, both piston rings 28 and 29 are directly positioned on expanding regions 44 and 45. Hence bearing rings 13 and 15 are eliminated in this embodiment. At their side surfaces 46 and 47, which face each other, piston rings 28 and 29 are supported against the end faces 26 and 27, respectively, of the spacer sleeve 14.

The material is chosen according to the same criteria as in the embodiment of FIGS. 1 and 2. The piston rings exhibit the largest thermal expansivity, the spacer sleeve the lowest thermal expansivity and the core a thermal expansivity lying between these values. During cooling-down, the shortening of core 2 in the axial direction is greater than that of spacer sleeve 14. Therefore, the piston rings 28 and 29 are pushed to the ends of core 2 and are thereby expanded. In this case, too, appropriate dimensioning and suitable combination of the thermal expansion coefficients enable precise adaptation of the circumference of the outer surfaces 30 and 31 to the pump cylinder.

What is claimed is:

1. A reciprocating pump for a cryogenic fluid comprising:

a pump cylinder made of a material with low thermal expansivity, a piston displaceable in said pump cylinder, and piston rings made of a self-lubricating material with a large expansivity than the material of said pump cylinder held on the circumferential surface of said piston, said piston comprising a core made of a material with relatively large thermal expansivity and a spacer sleeve made of a material with low thermal expansivity surrounding said core, said core protruding on both sides from said spacer sleeve and having expanding regions increasing conically towards its free ends, and said piston rings surrounding said core in said expanding regions and supported against the end faces of said spacer sleeve.

2. A reciprocating pump as defined in claim 1, wherein said piston rings directly abut said conically expanding regions of said core.

3. A reciprocating pump as defined in claim 2, wherein said core consists of two components joined together within said spacer sleeve.

4. A reciprocating pump as defined in claim 1, wherein said expanding regions of said core are surrounded by a bearing ring divided up into segments by radial cuts to enable radial expansion of said bearing ring when axially displaced on said conically expanding regions said bearing ring supported at the end face of said spacer sleeve, and said piston ring surrounding said bearing ring and held thereon.

5. A reciprocating pump as defined in claim 4, wherein a conical surface of said bearing ring abuts the conical surface of said expanding region of said core, with the conicity of both parts being substantially identical.

6. A reciprocating pump as defined in claim 4, wherein said expanding region of said core is positioned on and releasable from said core at least at one end of said core.

7. A reciprocating pump as defined in claim 4, wherein said expanding regions comprise radially protruding flanges acting as axial stops for said piston rings.

* * * * *